US005755333A

United States Patent [19]

Stencel et al.

[11] Patent Number: 5,755,333

[45] Date of Patent: May 26, 1998

[54] METHOD AND APPARATUS FOR TRIBOELECTRIC-CENTRIFUGAL SEPARATION

[75] Inventors: John M. Stencel, Versailles; John L. Schaefer; Heng Ban, both of Lexington, all of Ky.; Dennis Finseth, Pittsburgh, Pa.

[73] Assignee: University of Kentucky Research Foundation, Lexington, Ky.

[21] Appl. No.: 577,639

[22] Filed: Dec. 22, 1995

[51] Int. Cl.[6] ..... B03C 7/00

[52] U.S. Cl. ..... 209/127.1; 209/139.2

[58] Field of Search ..... 209/127.1, 127.4, 209/128, 129, 130, 139.2, 139.1, 148, 147

[56] References Cited

U.S. PATENT DOCUMENTS

| | | | |
|---|---|---|---|
| 1,071,354 | 8/1913 | Schnelle | 209/130 |
| 1,152,442 | 9/1915 | Schniewind | 209/127.2 |
| 1,841,556 | 1/1932 | Stelz | 209/127 |
| 2,216,254 | 10/1940 | Schweitzer, Jr. | 209/126 |
| 2,559,076 | 7/1951 | Johnson | 209/127 |
| 3,493,109 | 2/1970 | Carta et al. | 209/11 |
| 4,284,496 | 8/1981 | Newton | 209/127.1 |
| 4,388,088 | 6/1983 | Rozmus, Jr. et al. | 55/101 |
| 4,482,351 | 11/1984 | Kitazawa et al. | 44/1 R |
| 5,224,604 | 7/1993 | Duczmal et al. | 209/127.1 |
| 5,251,762 | 10/1993 | Taylor et al. | 209/127.4 |
| 5,289,922 | 3/1994 | Inculet et al. | 209/127.1 |

OTHER PUBLICATIONS

Butler, W. Barry et al; Fly Ash Benefication and Utilization in Theory and in Practice; Mat. Res. Soc. Symp. Proc.; 1986; vol. 65. pp. 11–17.

Cochran, J.W. et al; Benefication of Fly Ash By Carbon Burnout; Proc. 10th International Ash Use Symp.; Jan. 1993; vol. 2; pp. 73–1 to 73–9.

Whitlock; David R.; Electrostatic Separation of Unburned Carbon From Fly Ash; 10th International Ash Use Symp.; Jan. 1993; vol. 2; pp. 70–1 to 70–12.

*Primary Examiner*—Kenneth Noland

*Attorney, Agent, or Firm*—King and Schickli

[57] ABSTRACT

A method for separating two species of particles present in raw feedstock includes electrically charging at least one of the species of particles being separated. Next is the subjecting of the particles to both centrifugal and electrostatic forces. This is done in a manner so as to provide an additive effect and thereby achieve enhanced separation of the two particle species. An apparatus for processing the raw feedstock in accordance with the method is also disclosed.

8 Claims, 1 Drawing Sheet

METHOD AND APPARATUS FOR TRIBOELECTRIC-CENTRIFUGAL SEPARATION

TECHNICAL FIELD

The present invention relates generally to the field of material separation and, more particularly, to a method and apparatus for electrostatically and centrifugally separating two species of particles present in a raw feedstock.

BACKGROUND OF THE INVENTION

Electrostatic separators of varying types are well known in the art. An example of this type of separator is disclosed in U.S. Pat. No. 3,493,109 to Carta et al. In the Carta et al. patent, ore particles are charged by triboelectricity. The Carta et al. separator includes a tangentially arranged inlet duct for feeding ore particles into a cyclone. The inner surface of the cyclone is coated with special materials. The dielectric constant or surface work function of these materials is intermediate that of the two species of particles to be separated. More particularly, physical contact and friction between the particles themselves and the coated inner surface of the separator produces charges of opposite polarity on the two species of particles to be separated. The charged particles are then delivered from the cyclone to a separation chamber including opposing electrodes of opposite polarity. An electric field results which tends to draw the charged particles apart thereby completing the separation process.

While the electrostatic separator disclosed in the Carta et al. reference takes full advantage of electrostatic forces for purposes of separation, it fails to follow through and take full advantage of any centrifugal forces to enhance the separation process. This is a significant shortcoming which limits the efficiency and effectiveness of the separation process in this prior art approach.

SUMMARY OF THE INVENTION

Accordingly, it is a primary object of the present invention to provide an improved method and apparatus for separating two species of particles present in a raw feedstock where those two particle species have differing dielectric constants or work functions.

Another object of the present invention is to provide a method and apparatus for triboelectric-centrifugal separation that advantageously utilize cooperating electrostatic and centrifugal forces to enhance separation efficiency and effectiveness.

Still another object of the present invention is to provide a method and apparatus for separating two species of particles present in a raw feedstock by combining centrifugal and electrostatic forces wherein continuous processing of feed materials is possible at a rate of 2000 lbs/hour or more.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved method is provided for separating two species of particles present in a raw feedstock.

The method includes the step of electrically charging at least one of the two species of particles being separated. Preferably, this is done by directing the raw feedstock along a flow path that brings the raw feedstock into contact with a triboelectric element. The triboelectric element is coated or constructed of a material having a dielectric constant or work function intermediate that of the two species of particles to be separated. Accordingly, frictional engagement of the particles with the triboelectric element and other particles produces charges of opposite polarity on the two species of particles to be separated.

The method further includes the step of subjecting the two species of particles to both centrifugal and electrostatic forces so as to provide an additive effect and achieve enhanced separation of the two species of particles. In order to achieve this end, the method includes the step of circulating the two species of particles along a spiral path so as to provide centrifugal forces for separating the two particle species by their differences in relative density.

Additionally, there is the step of providing a first electrode adjacent an axial centerline of the spiral path and electrically charging the first electrode so as to draw, by means of electrostatic force, a first of the two species of particles having a relative lesser density inwardly towards the axial centerline. Additionally, the method includes the providing of a second electrode adjacent the outer periphery of the spiral path and electrically charging the second electrode so as to draw, by means of electrostatic force, a second of the two species of particles having a relative greater density outwardly towards the outer periphery. Preferably, the electrodes are concentrically arranged and provided with charges of opposite polarity through connection with a variable voltage source. This arrangement produces the desired electric field that cooperates with the centrifugal force to achieve excellent separation results.

Advantageously, by, for example, varying the construction materials of the triboelectric element, the velocity of the particles along the spiral path, the extent of the space or gap between the two electrodes and/or the magnitude and/or polarity of the voltage applied to the electrodes, it is possible to customize the method to provide the most efficient and effective separation of any two species of particles being processed. Further, the additive effect of centrifugal and electrostatic forces in the separation process of the present method provides a separation efficiency heretofore unknown in the prior art.

In accordance with yet another aspect of the present invention, a triboelectro-centrifugal separator is provided for separating two species of particles present in a raw feedstock in accordance with the present method just outlined. Preferably, the separator includes a triboelectric section, a separation section and a variable voltage source. The triboelectric section includes a defined, annular flow path for the two species of particles to be separated, a triboelectric element for triboelectrically charging at least one of the two species of particles, an inlet for directing the raw feedstock along a spiral flow path into direct physical contact with the triboelectric element and an outlet for discharging the electrically charged feedstock.

The separation section preferably includes a chamber for receiving the two species of particles. The chamber of the separation section is in fluid communication with the outlet of the triboelectric section. A first electrode is provided adjacent an axial centerline of the chamber and a second electrode of opposite polarity is provided adjacent an outer wall defining an outermost periphery of the chamber.

Additionally, the separation section includes a first outlet for discharging the first of the two species of particles that is drawn by combined, cooperating centrifugal and electrostatic forces toward the axial centerline of the chamber. Further, a second outlet is provided for discharging the second of the two species of particles. The second particle species is drawn by combined, cooperating centrifugal and electrostatic forces toward the second electrode and outer wall.

The variable voltage source is connected to the is first and second electrodes and utilized to apply an electrical potential to those electrodes. The polarity and magnitude of the voltage is controlled to create the desired electric field to provide for electrostatic separation. More specifically, as noted above, contact between the two species of particles and the triboelectric element functions to electrically charge at least one of the two species and preferably both. The charged particles are subject to electrostatic forces in the electric field produced by the electrodes and are drawn toward or away from the electrodes depending upon (1) the magnitude and polarity of the charge on the particles; (2) the magnitude and polarity of the charge on the electrodes; and (3) the direction of the electric field. Of course, the spiraling motion of the particles provides centrifugal forces that also function to achieve separation. By providing the first and second electrodes with electrical potential of the desired polarity, the centrifugal and electrostatic forces may be made to cooperate to enhance the separation process.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Figures 1, 2:
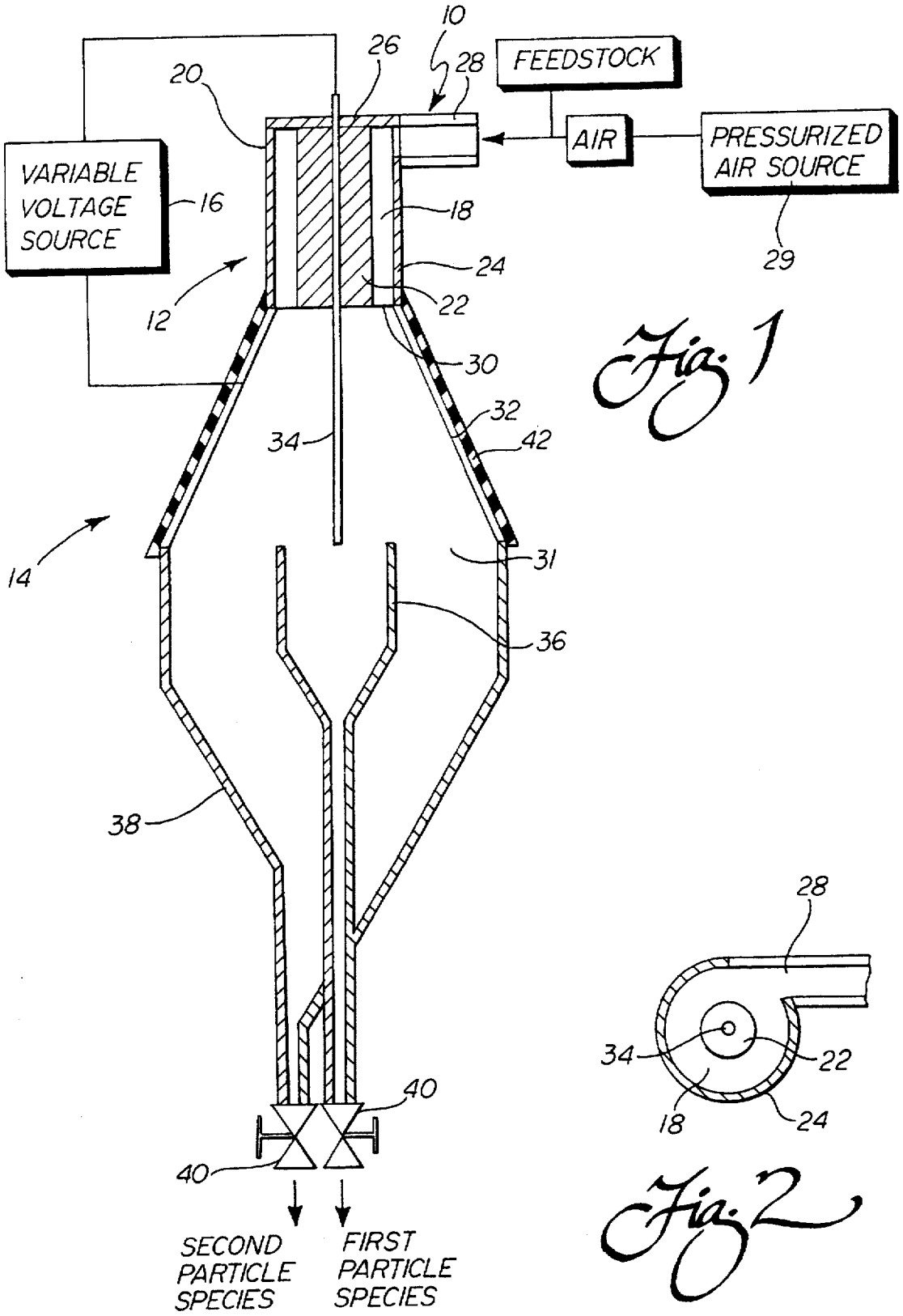
FIG. 1 is a schematical representation of a triboelectro-centrifugal separator that may be utilized in the present method for separating two species of particles in a raw feedstock.
FIG. 2 is a schematical partially sectional representation illustrating the tangentially directed inlet for feeding raw feedstock into the triboelectric section of the present apparatus.

Reference will now be made in detail to the present preferred embodiment of the invention, an example of which is illustrated in the accompanying drawing.

DETAILED DESCRIPTION OF THE INVENTION

Reference is now made to FIGS. 1 and 2 showing a triboelectro-centrifugal separator 10 that may be utilized in a method for separating two species of particles present in a raw feedstock. The separator 10 may be generally described as including a triboelectric section 12, a separation section 14 and a variable voltage source 16.

More specifically describing the invention, the triboelectric section 12 section an annular flowpath 18 for the raw feedstock including the two species of particles to be separated. The annular flowpath 18 is defined by a triboelectric element 20 including a core member 22 concentrically received within a cylindrical outer wall member 24. The core member 22 and cylindrical outer wall member 24 are held together by an endcap 26 that closes one end of the triboelectric element 20.

Preferably, the triboelectric element 20 is constructed from or lined with a dielectric material having a dielectric constant or work function intermediate the two species of particles desired to be separated. The material may be chosen in order to (1) selectively charge one of the species of particles to be separated while minimizing the charge of the other species or (2) selectively charge both of the species to be separated with different polarities. Generally, the materials selected for the triboelectric element 20 may be selected from a group consisting of metal, ceramic, plastic and mixtures thereof. Specific materials may, for example, be selected from a group such as copper, stainless steel, polytetrafluoroethylene, polytetraethylene, polypropylene, silica, alumina, iron, cobalt, nickel, tungsten, molybdenum, titanium, aluminum, zirconium, iron oxide, iron (II) oxide, iron (III) oxide, cobalt (II) oxide, cobalt (III) oxide, nickel monoxide, tungsten dioxide, tungsten trioxide, tungsten pentoxide, molybdenum dioxide, molybdenum trioxide, molybdenum pentoxide, molybdenum sesquioxide, titanium monoxide, titanium dioxide, titanium sesquioxide, aluminum oxide, zirconium oxide, polyvinylcholoride, polyurethane and mixtures thereof.

Alloys of the listed metals may also be utilized and, of course, it should be appreciated that this list of materials is illustrative and not exhaustive.

The raw feedstock including the two species of particles to be separated is delivered to the annular flowpath 18 between the core 22 and cylindrical outer wall member 24 of the triboelectric element 20 by means of an inlet 28. As should be appreciated, the inlet 28 functions to introduce the raw feedstock in a substantially tangentially oriented direction relative to the annular flowpath 18 (see particularly FIG. 2). Air or other gaseous medium from a pressurized feed source 29 is utilized to convey the raw feedstock through the triboelectric section 12 at a velocity of substantially 10–300 feet/second with the particle to air volume ratio being in the range of 1/1000 to 1/500.

When the feedstock enters the annular flowpath 18, it spirals downwardly rubbing along and physically contacting the core member 22 and cylindrical outer wall member 24 of the triboelectric element 20. As a result of this frictional engagement, at least one of the two species of particles to be separated is electrically charged. If both species are charged, they are charged with opposite polarity. As further shown in FIG. 1, the triboelectric section 12 includes an outlet 30 in fluid communication with the separation section 14. What is now electrically charged feedstock is delivered by this outlet 30 to the separation section 14.

The separation section 14 includes a chamber 31 for receiving the feedstock. This chamber 31 allows the particles to continue to travel along an uninterrupted spiral flowpath or course of travel. The chamber 31 is defined by an outer wall 32 which forms a truncated cone of smallest diameter adjacent the triboelectric section outlet 30. Thus, it should be appreciated that the volume of the chamber 31 gradually increases as the feedstock (including the two species of particles) spirals downwardly from the triboelectric section 12. Accordingly, in the chamber 31 the velocity of the feedstock gradually falls or slows to 1–25 feet/second. This is an important factor which aids in the effectiveness of the subsequent separation by means of the electrostatic forces.

As should be appreciated, the separation chamber 31 includes an axial centerline, generally designated by the letter C. A first electrode 34 is mounted in the separation chamber 31 adjacent to and substantially along the axial centerline C. As shown, the first electrode 34 may be mounted in and extend through a cooperating opening or bore hole provided in the end cap 26 and core member 22 of the triboelectric section 12. The portion of the electrode 34 received in the end cap 26 and core member 22 is preferably electrically insulated while the downwardly projecting portion extending into the separation chamber 31 is uninsulated thereby allowing the generation of an electric field and, thus, the application of electrostatic force to the particles for purpose of separation.

Preferably, the outer wall 32 of the separation section 14 is constructed of an electrically conductive material so as to function as a second electrode. The outer wall or second electrode 32 is concentrically disposed about the axial centerline C and the first electrode 34. This structural arrangement allows both centrifugal forces and electrostatic forces to be utilized in combination and cooperation to provide for enhanced separation of the particles in a manner to be described in greater detail below.

As further shown in FIG. 1, the separation section 14 includes a first collector and associated discharge outlet 36 for discharging a first of said two species of particles to be separated that has been drawn toward the axial centerline C by cooperating electrostatic and centrifugal forces. The separation section 14 also includes a second collector and discharge outlet 38 for collecting and discharging a second of said two species of particles to be separated drawn by the combined and cooperating electrostatic and centrifugal forces toward the outer wall or second electrode 32. Each of the first and second outlets 36, 38 may, of course, include a discharge or flow control valve 40.

Of course, it should be appreciated that the polarity and magnitude of the electrical potential applied to the first and second electrodes 34, 32 may be controlled by means of the variable voltage source 16 that is connected to the electrodes. For most applications, a voltage of between substantially 1000–50,000 volts is applied to the electrodes 34, 32. Of course, the outer wall or second electrode 32 is insulated from the triboelectric section 12 and the second collector and discharge outlet 38 that mate with the respective upper and lower ends of the outer wall. For added safety, the outer wall or second electrode 32 may also include an outer casing 42 of rubber or other non-electrically conducting material or is electrically grounded.

As should be appreciated from the above description, the method of the present invention for separating two species of particles present in a raw feedstock includes two basic steps. The first is electrically charging at least one of the two species of particles being separated. The second is the subjecting of the two species of particles to both centrifugal and electrostatic forces so as to provide an additive effect and achieve enhanced separation.

Thus, in use, the raw feedstock is conveyed in air and tangentially introduced by means of the inlet 28 into the annular flowpath 18 defined in the triboelectric section 12. As the feedstock spirals downwardly through the annular flowpath 18, the two species of particles rub and fictionally engage each other and the walls of the core member 22 and cylindrical outer wall member 24 of the triboelectric element 20. These two members 22, 24 are constructed or lined with chosen material that selectively charges at least one of the two species of particles to be separated. If both species of particles to be separated are electrically charged, they are charged with opposing polarity.

In the triboelectric section 12, the feedstock is preferably propelled with pressurized air at a velocity of between substantially 10–300 feet/second. This is sufficient to both electrically charge the particles and also provide centrifugal force for separating the two species of particles.

As the selectively charged feedstock travels through the outlet 30 and is delivered into the separation section 14, the downward spiraling motion of the flow stream is maintained as a consequence of the aerodynamic design of the triboelectric section 12 and separation chamber 31. In the separation chamber 31, the polarity and magnitude of the voltage applied to the first and second electrodes 34, 32 is controlled in order to produce an electric field having desirable characteristics. More specifically, the polarity of the first electrode 34 is selected to be opposite to the polarity of the electrically charged first species of particles. The first particle species is relatively less dense and, therefore, carried in the flow stream toward the axial centerline C of the separation chamber 31.

In contrast, the polarity of the outer wall or second electrode 32 is selected to be opposite to that of the polarity of the electrically charged second species of particles. The second particle species is of relatively greater density and, therefore, has been forced by centrifugal force toward the outer periphery of the flow stream. As a result of this design configuration it should be appreciated that it is possible to utilize both electrostatic and centrifugal forces in combination and cooperation to achieve a more efficient and effective separation of selected species of particles heretofore unavailable in the prior art.

Effective electrostatic separation is further insured since the sidewall 32 increases in circumference as the particles spiral downwardly. The resulting increase in volume serves to slow the velocity of the particles so that the electrostatic forces are relatively greater than and effectively overcome any continuing centrifugal forces. This allows separation of those smaller particles that were inadvertently trapped earlier in the process and unable to move under centrifugal force toward proper separation.

Of course, the first species of particles drawn by both centrifugal and electrostatic forces towards the first electrode 34 are collected and may be discharged through the first collector and discharge outlet 36. Similarly, the second species of particles which are drawn by centrifugal and electrostatic forces toward the outer wall or second electrode 32 are collected and may be discharged through the second collector and discharge outlet 38.

It has been found that the present method and apparatus are particularly useful for the separation and purification of energy and commodity materials. As a particular example, unburned carbon may be efficiently separated from coal fly ash. In such an application, the triboelectric element 20 is preferably lined or constructed with ceramic.

This is because ash particles have greater density (mass) than carbon particles—thereby experiencing a relatively larger centrifugal force at equal velocities (see Equation 2, below) - and because the charge on the ash particles can be minimized by using a tribocharger constructed of alumina and/or silica ceramics, the ash particles are positioned in the outer vortex of the flowpath where they are transported down and out of the separator. Also for the case of a ceramic tribocharger, because the carbon particles are less dense - thereby experiencing a relatively smaller centrifugal force at equal velocities (see Equation 2) - and because the magnitude and sign of their charge can be optimized, the electric field between the first and second electrodes 34, 32 will force carbon particles to the center of the flow path. At this position, carbon particles are captured by the gas stream exiting the separator 10 through the outlet 36. A more detailed description of forces acting on particles within the separator 10 follows.

The separator 10 to be used in this separation method includes a high velocity (10–300 ft/s), inlet and triboelectric section 12 and a relatively low velocity (<10 ft/s), electrostatic separation and particle disengagement section 14. This lower velocity section 14 contains electrodes 34, 32 that are cylindrically shaped in section, across which an electric field is established. Assuming a cylindrical shape with the electrode lengths much longer than their radii, r, an electric field strength, E, resulting from an applied voltage, V, gives a force ($F_e$) on a charged particle traveling through the electric field that is inversely proportional to the distance from the electrodes' center:

$$F_e = qE = \frac{qV}{r\ln(b/a)} \quad \text{(Equation No. 1)}$$

where:

q=particle charge.

r=radius measured from center of inner electrode to outer electrode b=inner radius of outer electrode a=outer radius of inner electrode.

The inertial or centrifugal force ($F_c$) acting on the particle as a result of it's tangential velocity (v) and tending to push the particle towards the outside electrode wall is:

$$F_c = \frac{mv^2}{r} \quad \text{(Equation No. 2)}$$

where:

m=particle mass;

r=radius of motion.

As coal ash/carbon mixtures are tribocharged (i.e. charged as a consequence of rubbing or contact action) in the triboelectric section 14, the charge on the ash particles is minimized (ceramic tribocharger) in comparison with the charge on the carbon particles. Therefore, the electrical force exerted on the ash particles is minimized in comparison with the charge on the carbon particles. As a result, the electrical force exerted on the ash particles is minimized in comparison to the electrical force exerted on the carbon particles, and centrifugal force dominates the motion of the ash particles. As the ash particles migrate towards the outer wall electrode 32 the ash particles are entrained in the outer gas vortex and converge to the discharge outlet 38 of the separation chamber 31. In contrast, the carbon particles are removed from the gas vortex by attraction to the center electrode 34 where they are entrained in the gas stream exiting the separation chamber 31 through the discharge outlet 36.

From rearrangement of Equations 1 and 2, the ratio of the electrical force-to-centrifugal force, $F_e/F_c$, on a particle is:

$$R = \frac{F_e}{F_c} = \left(\frac{q}{m}\right)\left(\frac{1}{v^2}\right)\left(\frac{V}{\ln(b/a)}\right) \quad \text{(Equation No. 3)}$$

To maximize R for the carbon particles: (1) q/m should be as great as possible and should be controlled by the tribocharging velocity and the selection of tribocharging material; (2) the tangential velocity, v, in the separation/chamber should be small and is controlled/adjusted by separator design, input velocities and gas dilution; (3) the voltage, V, in the separation chamber should be adjusted to enhance carbon recovery.

An example illustrating the use of the present method and apparatus for the purpose of unburned carbon and coal fly ash separation is illustrated below.

EXAMPLE

To show the applicability of the method to remove unburned carbon from coal fly ash, a sample from a utility combustor was obtained having a carbon content of 10% and was fed into the ceramic tribocharger section 14 of a triboelectro-centrifugal separator 10. The potential across the inner and outer electrode was set at 11.5 kV. Results of these tests are shown in Table 1, which shows that ash-carbon separation was improved at higher tribocharging velocities.

TABLE 1

Fly Ash Beneficiation
(Electric Potential = 11.5 KV)

| Normalized Charging Velocity | Percent Carbon (%) Carbon in Carbon Stream | Percent Carbon (%) Carbon in Ash Stream |
|---|---|---|
| 0.0 | 10 | 10 |
| 1.0 | ~14 | ~9 |
| 1.5 | ~17 | ~5 |
| 2.0 | ~34 | ~4 |

The carbon concentration in the ash stream was reduced to 5%, and the concentration of the carbon in the carbon stream was increased to 34%. These are results from "once-through" tests; it is expected that recycling one or both streams of particles would further enhance the ash-carbon separation.

In summary, numerous benefits result from employing the concepts of the present invention. Both centrifugal and electrostatic forces are harnessed to operate in concert and thereby enhance the separation of two species of particles with different dielectric constants. No prior art known utilizes such an approach or achieves such a synergistic effect.

Further, the apparatus and method may be used for either batch or continuous processing of materials. For example a tribocharger section inlet of approximately six inches in diameter and a separation chamber of approximately three feet in diameter at the small end and six feet in length will allow the processing of approximately 2000 pounds of material per hour. Further, various particles may be separated and specific applications include but are not limited to separating:

a.) mineral matter from coal;

b.) unburned carbon from fly ash;

c.) a mixture of ilmenite ($FeTiO_3$), forsterite; ($Mg_2SiO_4$), albite ($Na(AlSi_3O_8)$), augite ($(Ca,Na)(Mg,Fe,Al)(Si,Al)_2O_6$) and quartz;

d.) a mixture of minerals (inorganics) by themselves or inorganic—organic mixtures—e.g. sulfides from oxides, nitrides from oxides, carbides from oxides, polystyrene from polyurethane.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. A method for separating two species of particles present in a raw feedstock, comprising:

electrically charging at least one of said two species of particles being separated; and subjecting said two species of particles to both centrifugal and electrostatic forces by circulating said two species of particles to be separated along a spiral path at a velocity of between substantially 10–300 feet/second for purposes of achieving separation by means of centrifugal force and slowing the velocity of said particles to between substantially 1–25 feet/second for purposes of achieving separation by means of electrostatic force so as to provide an additive effect and achieve enhanced separation of said two species of particles.

2. The method set forth in claim 1, including providing a first electrode adjacent an axial centerline of said spiral path and electrically charging said first electrode so as to draw by means of electrostatic force a first of said two species of particles having a relative lesser density inwardly toward said axial centerline.

3. The method set forth in claim 2, including providing a second electrode adjacent an outer sidewall of said spiral path and electrically charging said second electrode so as to draw by means of electrostatic force a second of said two species of particles having a relative greater density outwardly toward said outer sidewall.

4. The method set forth in claim 3, including providing said first and second electrodes with charges of opposite polarity in order to establish an electric field.

5. The method set forth in claim 1, including providing an electrode adjacent an outer sidewall of said spiral path and electrically charging said electrode so as to draw by means of electrostatic force one of said two species of particles having a relative greater density outwardly toward said outer sidewall.

6. A triboelectro-centrifugal separator for separating two species of particles present in a raw feedstock, comprising:

a triboelectric section including a defined flow path for said two species of particles, a triboelectric element constructed from a material selected from a group consisting of metal, ceramic, plastic and mixtures thereof for electrically charging at least one of said two species of particles being separated, an inlet for directing the raw feedstock along the flow path and into direct physical contact with said triboelectric element and an outlet for discharging the electrically charged feedstock;

a separation section including a chamber for said two species of particles, said chamber being in fluid communication with said outlet of said triboelectric section and including a first electrode adjacent an axial centerline of said chamber, a second electrode of opposite polarity defining an outermost periphery of said chamber, a first outlet for discharging a first of said two species of particles to be separated drawn by combined, cooperating centrifugal and electrostatic forces toward said axial centerline and a second outlet for discharging a second of said two species of particles drawn by combined, cooperating centrifugal and electrostatic forces toward said second electrode; and a variable voltage source for applying electrical potential to said first and second electrodes.

7. The separator set forth in claim 6, wherein said inlet of said triboelectric section is tangentially oriented and said defined flow path is spiral.

8. The separator set forth in claim 6, wherein said triboelectric element is constructed from a material selected from a group consisting of copper, stainless steel, polytetrafluoroethylene, polytetraethylene, polypropylene, silica, alumina, iron, cobalt, nickel, tungsten, molybdenum, titanium, aluminum, zirconium, iron oxide, iron (II) oxide, iron (III) oxide, cobalt (II) oxide, cobalt (III) oxide, nickel monoxide, tungsten dioxide, tungsten trioxide, tungsten pentoxide, molybdenum dioxide, molybdenum trioxide, molybdenum pentoxide, molybdenum sesquioxide, titanium monoxide, titanium dioxide, titanium sesquioxide, aluminum oxide, zirconium oxide, polyvinylcholoride, polyurethane and mixtures thereof.

* * * * *